US007529344B2

(12) United States Patent
Oreper

(10) Patent No.: US 7,529,344 B2
(45) Date of Patent: May 5, 2009

(54) DUAL ENERGY X-RAY SOURCE

(75) Inventor: Boris Oreper, Newton, MA (US)

(73) Assignee: L-3 Communications Security and Detection Systems Inc., Woburn, MA (US)

( * ) Notice: Subject to any disclaimer, the term of this patent is extended or adjusted under 35 U.S.C. 154(b) by 88 days.

(21) Appl. No.: 11/809,253

(22) Filed: May 31, 2007

(65) Prior Publication Data

US 2008/0260101 A1 Oct. 23, 2008

Related U.S. Application Data

(60) Provisional application No. 60/809,458, filed on May 31, 2006, provisional application No. 60/816,251, filed on Jun. 23, 2006.

(51) Int. Cl.
*H01J 35/06* (2006.01)

(52) U.S. Cl. ..... 378/134

(58) Field of Classification Search ..... 378/101, 378/119, 121, 134, 136, 5, 57
See application file for complete search history.

(56) References Cited

U.S. PATENT DOCUMENTS 4,823,371 A 4/1989 Grady
2004/0247082 A1* 12/2004 Hoffman ..... 378/119

* cited by examiner

*Primary Examiner*—Courtney Thomas
(74) *Attorney, Agent, or Firm*—Wolf, Greenfield & Sacks, P.C.

(57) ABSTRACT

A dual energy X-ray source for use in an explosive detection system includes only a single power supply and only a single X-ray tube. The X-ray tube includes only two electron guns and only a single anode. Each electron gun has its own grid and cathode. The X-ray source switches between producing a higher energy X-ray and producing a lower energy X-ray at a frequency of at least 4000 Hz.

17 Claims, 2 Drawing Sheets

DUAL ENERGY X-RAY SOURCE

CROSS-REFERENCE TO RELATED APPLICATIONS

This application is a non-provisional that claims priority under 35 USC 119(e) to provisional application No. 60/809,458 filed on May 31, 2006, and to provisional application No. 60/816,251 filed on Jun. 23, 2006.

BACKGROUND

Explosive Detection Systems (EDS) are used for detecting explosives and other contraband. They are used commonly in the airline industry and their prevalence and importance has increased after 9/11.

It is critically important that the technology used in EDS be sufficiently advanced so as not to miss the detection of explosives. Balanced with that, the technology should be sufficiently advanced so as to minimize false alarms and maximize throughput.

EDSs commonly use X-rays to penetrate an object of interest, such as a bag or container, which is placed on a conveyer belt and moved through the system. X-rays are emitted from an X-ray source and are directed at the object. Transmitted and/or reflected or refracted X-rays are detected by detectors. An image of the object is reconstructed from the detected X-rays and a threat detection is made, either manually by an operator who views the image, or automatically by a threat detection algorithm implemented in software.

The use of computed tomography (CT) scanners are known in the industry as a sensitive and accurate EDS, but typically have a lesser throughput. Advancements in CT EDS technology have improved throughput. A CT scanner is helpful in that it can determine the density of an object being observed. Determining the density can enable the system to decipher most explosives. There are, however, innocuous materials that are close in density to explosives, causing a high false alarm rate when basing the determination solely on density. Similarly, density alone is not sufficient information to decipher all explosives.

Dual energy CT scanners are known in the industry and enable the determination of $Z_{effective}$ of an object of interest, which enables the determination of the material from which the object is made, in order to decipher explosives. In other words, determining the $Z_{effective}$ of an object will enable one to discriminate it from objects of similar density, when density alone would not enable such discrimination.

Several approaches exist for the use of dual energy CT scanning. One such approach is employed in the L-3 Communications Examiner® EDS. The Examiner employs a dual energy X-ray source. A high-voltage power supply switches between a higher voltage (e.g., 160 Kv) and a lower voltage (e.g., 80 Kv). The power supply switches from the high voltage to the low voltage at a certain frequency which in turn causes the X-ray source to emit high energy X-rays and low energy X-rays at this frequency.

One drawback associated with this approach is the significant limitation on the frequency with which the power supply can switch from high to low and low to high. When switching from high to low, a sufficient amount of time must pass in order to enable the dissipation of the energy built up during the high-energy phase. Similarly, when switching from low to high, a sufficient amount of time must pass in order to build up the energy needed to obtain the high voltage required. Thus, present systems employing this approach have frequency limitations. One such system, the Multiview Tomography (MTV) system of L-3 Communications, can switch up to 240 times per second, well below the desired frequency of a few kHz for next generation CT scanners.

Another approach at dual energy CT scanning employs the use of two sets of detectors, each detector set sensitive to a different energy level. This approach uses one single energy X-ray source. As it is, CT scanners use multiple detectors. This approach would double the number of detectors, which results in several drawbacks: size, manufacturability, and cost, among them.

SUMMARY

Applicants herein have invented a dual-energy X-ray source that employs a single output DC (direct current) high-voltage power supply and a single tube. There are two electron guns included in the single tube, each gun having its own grid but both sharing a single anode.

In an embodiment, each of the guns is driven by the single, high-voltage power supply, one at a higher voltage and one at a lower voltage. One gun, through the use of its own grid, strikes the anode at a first angle. The second gun, through use of its own grid, strikes the anode at a different and second angle.

Such an approach enables a dual-energy X-ray source without the need for high voltage switching and provides for very fast switching, likely on the order of a frequency of greater than 10K Hz.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE INVENTION

The present invention is directed at a high-frequency dual-energy X-ray source employable in a CT-based EDS or for other medical or non-medical applications where dual-energy X-ray screening is employed. The switching (from high energy to low energy and visa versa) frequency obtainable likely is on the order of 10K Hz or greater. The system employs a single output DC high-voltage power supply, and a single X-ray tube. The X-ray tube itself includes two electron guns, each having its own grid, and a single anode shared by both guns. One gun is driven at a high voltage and emits electrons through its grid at a first angle to the anode and the second gun is driven at a low voltage and emits electrons through its grid at a second angle to the anode.

As discussed in the Background section, it is advantageous to use dual energy in a CT scanning EDS to enable the determination of the $Z_{effective}$ of a material, in addition to the density of the material, in order to locate and discriminate explosives from surrounding objects. The conventional dual-energy X-ray source approach suffered from frequency limitations. The multiple detector approach suffered from cost, equipment manufacturability and clumsiness limitations, as well as size constraints.

Another approach, involving the use of two power supplies, each feeding its own X-ray tube, was contemplated.

Such an approach can switch with sufficient frequency, which overcomes the speed limitation of the dual energy power supply approach. Such an approach, however, suffers from an inability to sufficiently filter out scatter radiation from the object. A scatter filter is needed for such purpose and must be tuned to one of the tubes, each of which is spatially different.

The present approach, described herein, discovered by Applicant, overcomes the drawbacks of the prior art. For example, it does not suffer from the scatter radiation problem above as only a single tube is used, for which a scatter radiation filter can be tuned.

Figure 1:
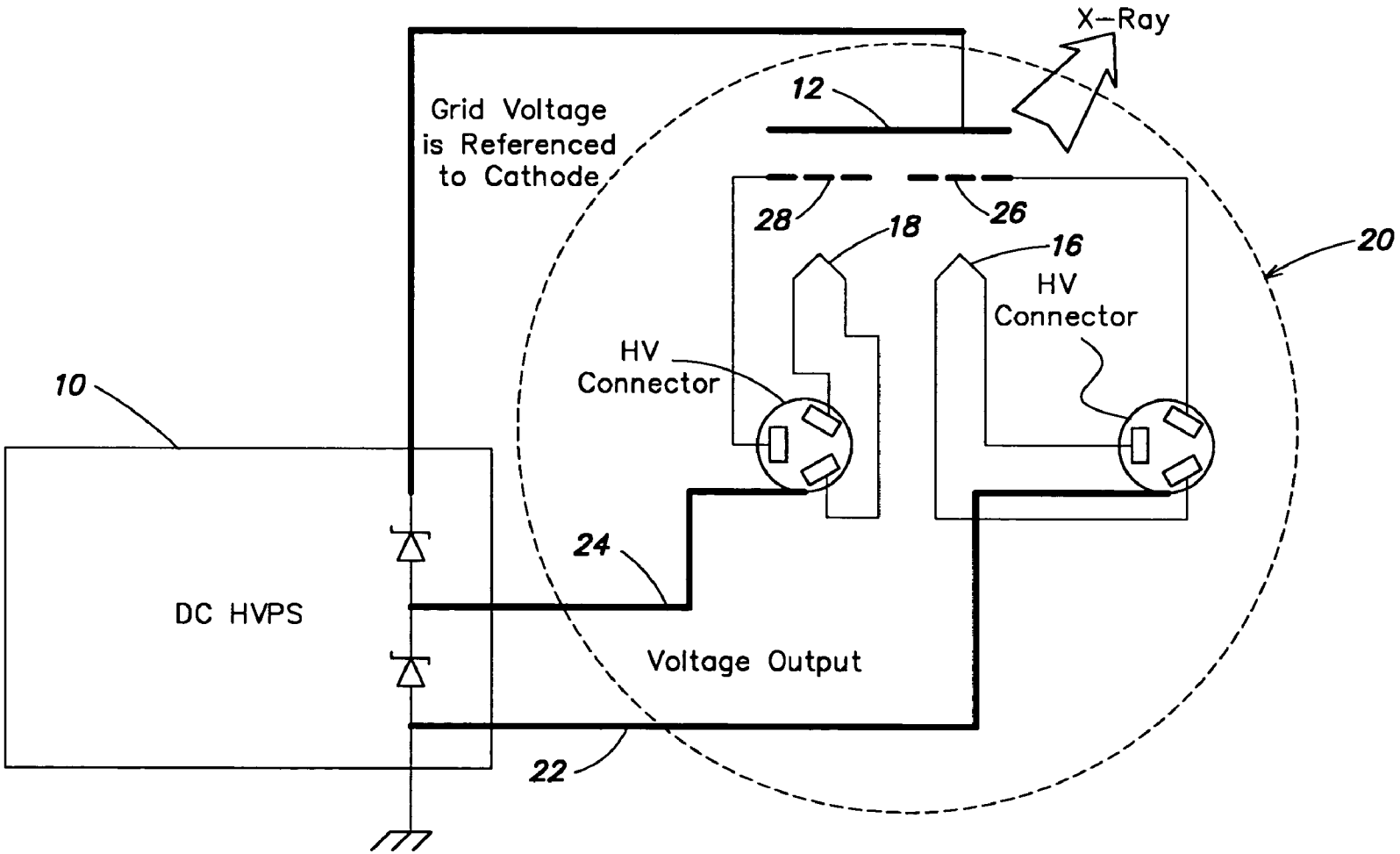
FIG. 1 is a block diagram of a dual-energy X-ray source system.

FIG. 1 illustrates a dual-energy X-ray source approach according to the present invention. As shown, the system includes a DC high-voltage power supply 10, which generates both high and low voltages, the high voltage being provided along line 22 and the low voltage being provided along line 24. In one embodiment, the high-energy output voltage is 160 KV and the low-energy output voltage is 80 KV, but the invention is not so limited.

The system also includes a single tube 20. Within the single tube 20 is included a first electron gun 16 and a second electron gun 18. Also included is a single anode 12. Each gun has a filament and its own grid. First gun 16, which receives the high-voltage output from the power supply, has its own grid 26. Second gun 18, which receives the low-voltage output from the power supply, has its own grid 28. Gun 16 shoots electrons through its grid to anode 12 at a first angle to emit X-ray radiation at a high energy. Second gun 18 shoots electrons through its grid 28 to anode 12 at a second angle to emit X-ray radiation at a lower energy. The angles are different, preferably symmetrical along a vertical axis of symmetry. The electrons impinge on the anode preferably at the same location. The target emits X-ray radiation from this location, thus forming a focal spot. The anode produces a core beam of X-ray radiation and a collimator may be used to channel the X-ray radiation. The two guns should be spatially separated by a clearance sufficient to withstand a significant voltage difference without a discharge.

The following equation represents the system of the invention: $V=3\times10^6 L^{0.8}$, where V is voltage difference between the guns in volts, and L is the distance between the two guns in a vacuum in meters. For a particular case when one gun is at 80 kV, another gun is at 160 kV, the distance L should be approximately 25 mm or more. One should appreciate, however, that it is possible to have the anode at +80 kV, one gun at −80 kV, and the other gun at 0 kV. This will not change the voltage difference between the two guns from 80 kV, nor will this change the energy of the produced X-rays. Other voltage settings are envisioned to suit a particular application.

Figure 2:
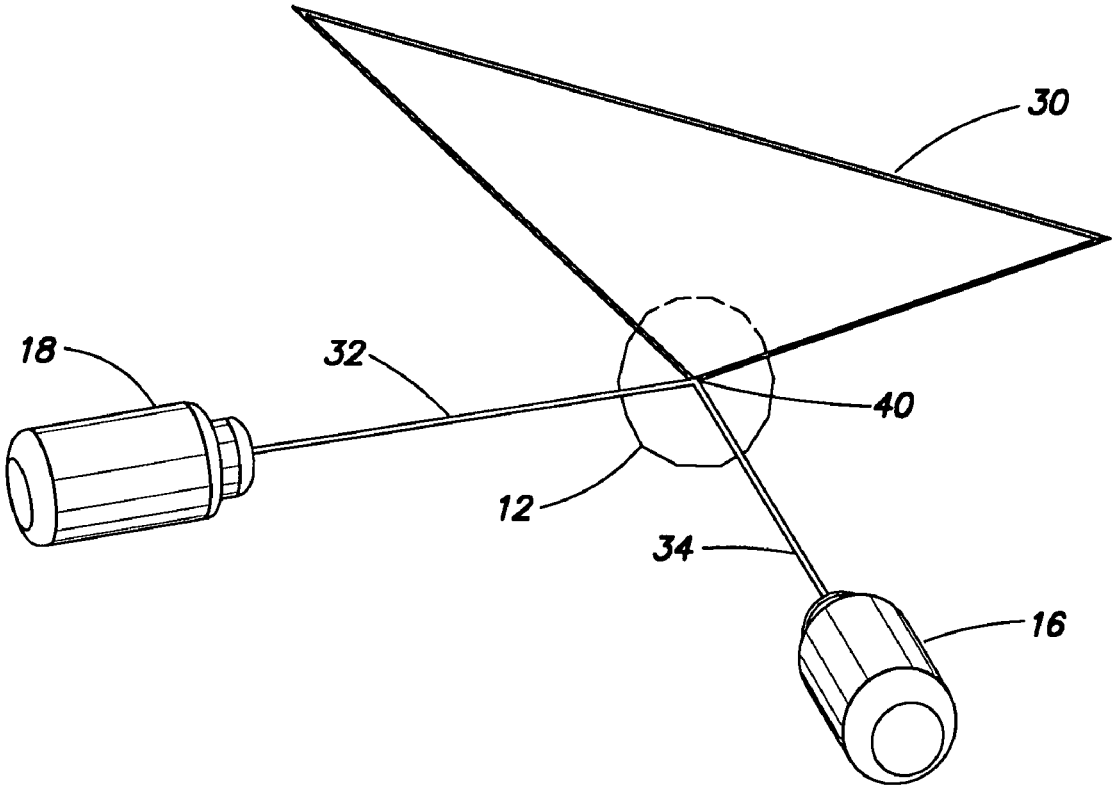
FIG. 2 illustrates in further detail portions of the system of FIG. 1.

FIG. 2 illustrates the portions of the system of the invention during use. As shown, the system includes first electron gun 16 and second electron gun 18, each of which receives power from the power supply (not shown). First electron gun 16 shoots electrons at a high energy (shown as electron beam 34) to a focal spot 40 on anode 12. Electron gun 18 similarly shoots electrons at a low energy (shown as electron beam 32) to focal spot 40 on anode 12. Anode 12, from focal spot 40, in turn, produces fan beam 30 through a collimator (not shown).

This approach enables very fast switching, on the order of up to a frequency of 10K Hz or higher as the need for energy dissipation or additional energy is eliminated. Because only a single tube, with one focal spot, is used, a scatter filter can be tuned to the single tube, which addresses the scatter issue associated with the previously contemplated approach, discussed above. Finally, multiple detectors are not used in this approach, which addresses the cost and manufacturability issue associated with the prior art approach discussed.

Advantages obtained by this approach include the reduced cost, size and weight of the system. In addition, manufacturability and maintainability of the system both improve because of the need for fewer components. Further, with a reduced size and weight, such systems put less stress on a CT gantry in a CT-based EDS. Additionally, radiation shielding is simplified due to the more compact design.

It should be appreciated that this invention is not limited to the EDS application, but has other such applications, such as in the medical field, as well.

What is claimed is:

1. A dual energy X-ray source comprising:
a power supply; and
only a single X-ray tube, the X-ray tube comprising:
only two electron guns and only a single anode,
each electron gun having a grid and a cathode, a first of the cathodes always connected to receive a first voltage and a second of the cathodes always connected to receive a second voltage, the first voltage being higher than the second voltage.

2. The dual energy X-ray source as claimed in claim 1 wherein each cathode has a heated filament.

3. The dual energy X-ray source as claimed in claim 1 wherein each cathode is a cold cathode that uses field emission.

4. The dual energy X-ray source as claimed in claim 3 wherein each cathode further uses carbon nanotubes.

5. A dual energy X-ray source as claimed in claim 1 wherein the anode is fixed.

6. A dual energy X-ray source as claimed in claim 1 wherein the grid is fixed.

7. A dual energy X-ray source as claimed in claim 1 wherein the X-ray tube is absent a filter.

8. An explosive detection system comprising:
a dual energy X-ray source comprising only a single X-ray tube, the X-ray tube comprising:
only two electron guns and only a single anode,
each electron gun having a grid and a cathode, a first of the cathodes always connected to receive a first voltage and a second of the cathodes always connected to receive a second voltage, the first voltage being higher than the second voltage; and
at least one X-ray detector.

9. The explosive detection system as claimed in claim 8 wherein each cathode has a heated filament.

10. The explosive detection system as claimed in claim 8 wherein each cathode is cold.

11. An explosive detection system as claimed in claim 8 wherein the anode is fixed.

12. An explosive detection system as claimed in claim 8 wherein the grid is fixed.

13. An explosive detection system as claimed in claim 8 wherein the X-ray tube is absent a filter.

14. A multiple energy X-ray source comprising:
a power supply; and
only a single X-ray tube, the X-ray tube comprising:
multiple electron guns and only a single anode,
each electron gun having a arid and a cathode, each of the cathodes always connected to receive a different voltage.

15. A multiple energy X-ray source as claimed in claim 14 wherein the anode is fixed.

16. A multiple energy X-ray source as claimed in claim 14 wherein the grid is fixed.

17. A multiple energy X-ray source as claimed in claim 14 wherein the X-ray tube is absent a filter.

* * * * *